United States Patent [19]

Edmisten

[11] 4,209,157

[45] Jun. 24, 1980

[54] FIREARM HANGER

[76] Inventor: John H. Edmisten, P.O. Box 293, Boone, N.C. 28607

[21] Appl. No.: 862,617

[22] Filed: Dec. 20, 1977

[51] Int. Cl.[2] ..... F16M 13/00

[52] U.S. Cl. ..... 248/360; 42/85; 42/90

[58] Field of Search ..... 248/214, 221.3, 221.4, 248/339, 340, 359, 360; 211/64; 224/1 R, 1 A, 3; 42/85, 90

[56] References Cited

U.S. PATENT DOCUMENTS

| | | | |
|---|---|---|---|
| 1,674,305 | 6/1928 | Sedlock et al. | 248/214 X |
| 3,045,832 | 7/1962 | Hibbard | 211/64 |
| 3,468,508 | 9/1969 | Huver | 248/359 X |
| 3,556,454 | 1/1971 | Huver | 248/360 X |
| 3,704,537 | 12/1972 | McKinzie | 42/85 |

FOREIGN PATENT DOCUMENTS

| | | | |
|---|---|---|---|
| 292150 | 8/1916 | Fed. Rep. of Germany | 42/85 |
| 1138193 | 10/1962 | Fed. Rep. of Germany | 42/85 |

*Primary Examiner*—William H. Schultz
*Attorney, Agent, or Firm*—Bell, Seltzer, Park & Gibson

[57] ABSTRACT

A device for securing to a post, such as a swivel post, mounted on or carried by a firearm so as to enable a hunter climbing into a tree to suspend his firearm on successively higher tree limbs and thereby free his hands for climbing. The firearm hanger comprises a hook member for securing the firearm to a tree limb and a connector member affixed to one end of the hook member for detachably securing it to the post mounted on or carried by the firearm.

5 Claims, 5 Drawing Figures

FIREARM HANGER

This invention relates to a firearm hanger and is particularly directed to a firearm hanger adapted to be utilized when the hunter desires to climb a tree with his firearm.

Typically, a hunter when desiring to climb a tree for observaton or a better shooting position is faced with difficulty and danger in attempting to carry his firearm with him. Heretofore, a hunter has had several alternative techniques available to transport his firearm upwardly into a tree into which he desired to position himself. First, if the firearm were equipped with a sling the hunter could position the firearm over his shoulder and climb upwardly into the tree with it strapped to his back. However, this approach produces problems with regard to obstructions, such as tree limbs, engaging the firearm and hindering the hunter's climb into the tree and to his desired position therein. Second, the hunder could climb into the tree without his firearm and subsequently have it handed upwardly to him by another party on the ground or, perhaps, the hunter could even pull it upwardly to his position by a rope previously attached thereto. This particular technique is time consuming and presents a possibility, if the firearm has not been unloaded, of the firearm discharging and causing injury or death to the hunter. Finally, the hunter could attempt to climb into a tree and to a desired position while simultaneously transporting his firearm in one hand. This technique presents obvious disadvantages to the hunter of increasing the difficulty of his climb and, if the firearm has not been unloaded, increasing the danger of accidental discharge of the weapon during the climb.

From the description hereinbefore it can be clearly seen that the firearm increases the difficulty associated with a hunter climbing upwardly into a tree for an observation or shooting position. Furthermore, although one would expect that a prudent hunter would unload his firearm prior to climbing into a tree, the firearm would pose a danger to the hunter climbing into a tree if he were to violate normal safety rules and not do so.

Prior art hangers for firearms have typically comprised a hanging means adapted for securing to a portion of the firearm, such a the muzzle or butt, to provide for storing or hanging the firearm in a suspended position. Such devices are understood to be inherently inadequate to suspend a firearm from either a tree limb or other large diameter supporting member since the hangers will not normally engage the same. Another type of prior art hanger, intended to provide for suspending the firearm from the hunter's person, comprises a hook mounted on a strap about the hunter's body for supporting the firearm, but does not provide practical means for suspending the firearm from a tree limb or similar supporting member. As can now be clearly understood, none of the prior art devices provides a hanger which can alleviate the danger and difficulty associated with a hunter attempting to climb into a tree with his firearm.

In light of the above, an object of the invention is to provide a simple and reliable firearm hanger to enable a hunter to more easily and safely climb into a tree with his firearm.

It is also an object of the invention to provide a detachable firearm hanger which is adapted for being detachably secured when needed to a post, such as a swivel post, mounted on or carried by the firearm.

In realizing the objects of the present invention, a hunter will utilize a detachable firearm hanger which is adapted to be secured by the hunter to a post means carried by the firearm, such as a swivel post or a modified sling having a post thereon. When the hunter no longer has a need for the firearm hanger, he may desire to detach the firearm hanger from his firearm and return it to his pocket or other convenient place of storage.

It can thus be seen that the firearm hanger device of this invention is intended to add to the pleasure and safety of hunting.

Some of the objects and advantages of the invention having been stated, other objects will become evident as the description proceeds, when taken in connection with the accompanying drawings in which.

Figure 1:
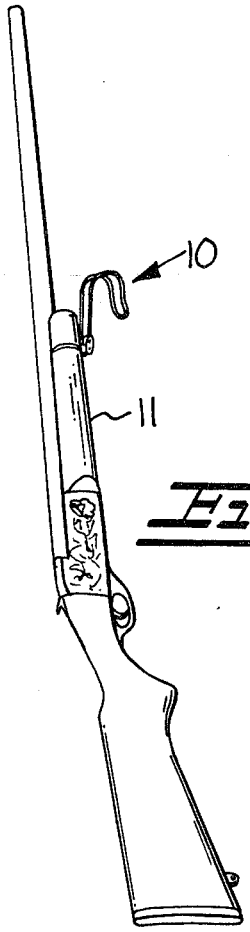
FIG. 1 is a perspective view of a firearm with the device of this invention mounted thereon.

Referring now more specifically to the drawings, FIG. 1 shows the device of this invention, broadly indicated at 10, affixed to a firearm 11 which has had the sling removed so as to accommodate the invention thereon. The detachable firearm hanger 10 is adapted for securing to an element, such as a post, of a firearm sling swivel. With this quickly attachable device a hunter may, among other uses, suspend his firearm from supporting members such as tree limbs while he climbs upwardly into a tree for an advantageous hunting or observation position.

Figure 2:
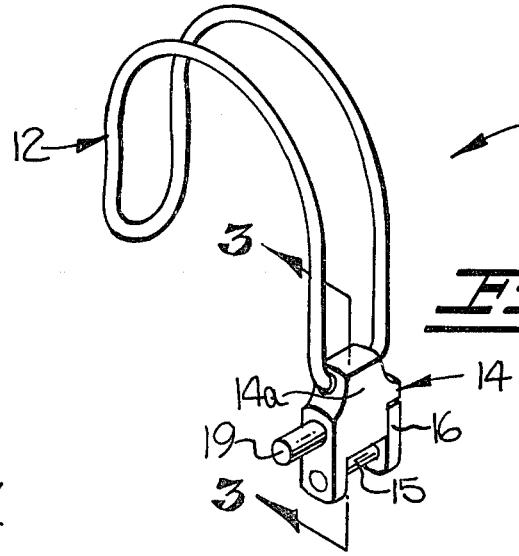
FIG. 2 is a perspective view of the detachable firearm hanger of this invention.

As shown in greater detail in FIG. 2, the detachable firearm hanger 10 comprises a hook means, broadly indicated at 12, for securing a firearm to a tree limb or other support member and a connector means, broadly indicated at 14, fixedly secured thereto for securing the detachable firearm hook 10 to the firearm (not shown). The hook means 12 of the firearm hanger 10 is preferably in the form of an inverted U-shaped hanger.

Figure 3:
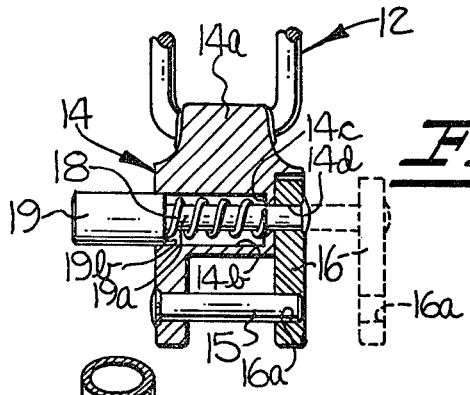
FIG. 3 is a vertical sectional view taken along line 3—3 of FIG. 2.

The particular construction of the connector means 14 is more clearly shown in FIG. 3 where the connector means 14 of the firearm hanger 10 can be seen in the closed position and (in phantom lines) in the open position. The connector means 14 comprises a body portion **14*a*, transverse pin 15, closure member 16, and a spring means 18, typically in the form of a helical spring, for urging the closure member 16 into engagement with the free end of the pin 15. A projecting push pin 19 fixedly engages the closure member 16 and is utilized to compress the helical spring 18 and relocate the closure member 16 to the open (phantom lines) position for engagement of the transverse pin 15 of the connector means 14** with an element, such as a post, of a firearm sling swivel.

The body portion **14*a* of the connector means 14 is provided with a transverse chamber 14*b* therein, the chamber having shoulder portions 14*c* defining a hole 14*d* in one end thereof and the other end of the chamber 14*b* being open ended. As can be observed from the drawing, the projecting push pin 19 has an enlarged portion extending within portions of the chamber 14*b*** and outwardly from the open end thereof, said enlarged portion having a diameter substantially the same as that of the chamber 14b so that the enlarged portion can slide therein. The normal diameter portion 19a of the projecting push pin 19 extends through the remainder of the chamber 14b, through the hole 14d in the end thereof, and is fixedly secured to the closure member 16. The helical spring 18 is positioned within the chamber 14b and around the normal diameter portion 19a of the projecting push pin 19 so as to abut shoulder portion 14c at one end and shoulder 19b of the enlarged portion of the push pin 19 at the other end. Therefore, when the projecting push pin 19 is pressed inwardly the helical spring 18 is compressed and urges the projecting push pin back towards its normal positon in relation to the chamber 14b. It can be further observed that the transverse pin 15 is positioned substantially parallel to both the chamber 14b and the push pin 19 and is fixedly secured at one end to the body portion 14a and at the other end releasably resides in a hole 16a in the closure member 16 when said connector means 14 is in the closed position.

Figure 4:
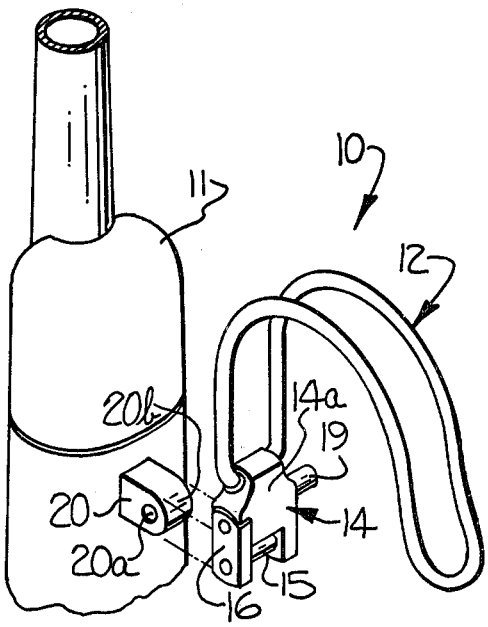
FIG. 4 is an exploded perspective view of a portion of FIG. 1.

Referring next to FIG. 4, it can be seen and understood that the transverse pin 15 and the closure member 16 of the connector means 14 cooperatively engage an element of a firearm sling swivel, such as post 20, carried by the firearm portion of firearm 11. Post 20, having a transverse opening 20a extending therethrough, may be of well known construction and is normally utilized in conjunction with a second post in the butt portion of a firearm stock to serve as a connecting post for securement of a sling thereto. However, preferably the post 20 is constructed so as to engage the body portion 14a of the connector means 14 as it pivots from an angle substantially parallel to the firearm stock to an angle substantially perpendicular therewith. To accomplish this, the post 20 has a raised crown portion 20b which serves for engaging the body portion 14a of the connector means 14 as it pivots from an angle substantially parallel to the firearm stock to an angle substantially perpendicular therewith. Thus it will be appreciated that the crown portion 20b serves for maintaining the hook means 12 in a position for receiving a supporting member.

Figure 5:
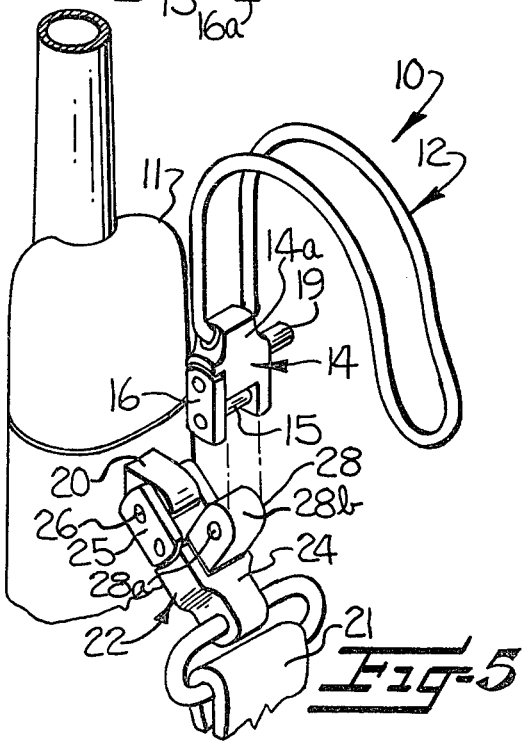
FIG. 5 is an exploded perspective view of a second embodiment of this invention.

A second embodiment of the invention, shown in FIG. 5, essentially differs from that embodiment shown in FIGS. 1 and 4 in that a sling 21 is shown as being present on the firearm with the firearm hanger 10 being attachably connected to a link means or modified sling swivel connector, generally indicated at 22. The second embodiment comprises the firearm hanger 10, as previously described, and the link means 22 for operatively engaging the post 20 secured to the firearm 11. The elements of the second embodiment cooperate with each other and with the post 20 for the most part as the connector means 14 and the post 20. As can be further seen, the link means 22 is comprised of a body 24, a closure member 25, and a transverse pin 26 cooperating with the closure member 25 for pivotally engaging the post 20. A post 28 is mounted on the body 24 and has a transverse opening 28a extending therethrough to facilitate a cooperative engagement with the transverse pin 15 of the firearm hanger. As in the previous embodiment, this embodiment is also preferably constructed with a raised crown portion 28b for a similar purpose as already explained in the first embodiment with reference to the raised crown portion 20b therein. As can also be seen, the link means 22 is essentially a modified fom of the structure which has been used previously as a swivel connector for the sling 21.

In operation, a hunter would take the firearm hanger 10 from his pocket or other place of storage and push the projecting push pin 19 inwardly with his thumb so as to open the connector means 14 by positioning the closure member 16 (phantom lines FIG. 5) so that it is out of cooperating engagement with the transverse pin 15. The closure member 16 and push pin 19 fixedly secured thereto will be laterally shifted to the open position in which the end of the transverse pin 15 is exposed, and the push pin 19 and closure member 16 will then be pivoted as a unit so that the transverse pin 15 and the hole 16a in the closure member 16 will not be in longitudinal alignment. Next, the hunter would place the connector means 14 of the firearm hanger 10 into a cooperating position with the post 20, or into a cooperating position with the post 28 if he were utilizing the second embodiment of the invention, where the transverse pin 15 would be in longitudinal alignment with the transverse opening, 20a or 28a respectively, extending through the post. The hunter then would insert the transverse pin 15 through the opening 20a or 28a, pivot the closure member 16 to the position where the hole 16a therein is in longitudinal alignment with the transverse pin 15, and release the push pin 19 so as to secure the connector means 14 to the post.

It should be particularly noted from FIGS. 4 and 5 that the hunter may attach the connector means 14 to the post 20 if a sling is not attached thereto. If the sling 21 is in use and the link means 22 secured to the post 20, the hunter can secure the connector means 14 to post 28 of the link means 22.

Also, although engagement of the firearm hanger to posts associated with the forearm portion of the stock of the firearm has been described to this point, it should be understood that a hunter may also secure the detachable firearm hanger of this invention to a post positioned on the butt end of the firearm stock and suspend the firearm from a tree limb, or other support member, by its butt end.

It will thus be seen that there is provided as described hereinbefore, a simple and reliable detachable firearm hanger which can, among other uses, be used to enable a hunter climbing into a tree to substantially free his hands for climbing. Through the use of the detachable firearm hanger the hunter can more quickly climb into a tree for advantageous shooting or observation position.

In the drawings and specification, there have been set forth preferred embodiments of the invention, and although specific terms are employed, they are used in a generic and descriptive sense only and not for purposes of limitation.

What is claimed is:

1. The combination comprising a firearm having a post with a bore therethrough; and a hanger for hanging said firearm from a supporting member such as the limb of a tree, said hanger comprising hook means and connector means affixed to one end of said hook means and pivotally connected to said post, said connector means comprising a pin extending in predetermined relation to said hook means and through said bore and closure means cooperating with said pin for detachably connecting said hanger to said firearm.

2. The combination comprising:

a firearm, post means carried by said firearm, said post means having a transverse bore therethrough, hook means for securing said firearm to a supporting member, and connector means affixed to one end of said hook means for securing said hook means to said post means, said connector means comprising a transverse pin for penetrating said bore and a closure member cooperatively engageable with said pin for securing said hook means to said post means, whereby said firearm can be readily suspended from a supporting member.

3. The combination according to claim 2 wherein said connector means further comprises spring means for urging said closure member into engagement with said pin.

4. The combination comprising:

an elongate firearm having a stock, a post fixed in said stock near one end of said firearm and having a transverse bore therethrough, suspender means having one end adapted for hooking engagement with a supporting member for detachably securing said firearm to the supporting member, and connector means affixed to the other end of said suspender means for detachably securing said suspender means to said post means, said connector means comprising a transverse pin for penetrating said bore and a closure member cooperatively engageable with said pin for securing said suspender means to said post, whereby said firearm can be readily suspended in a substantially vertical position from a supporting member.

5. The combination comprising:

an elongate firearm having a forearm portion, a post member connected to said forearm portion of said firearm and having a transverse bore therethrough, suspender means for detachably securing said firearm to a supporting member, and connector means affixed to one end of said suspender means for detachably securing said suspender means to said post member,, said connector means comprising a transverse pin for penetrating said bore and a closure member cooperatively engageable with said pin for securing said suspender means to said post, whereby said firearm can be readily suspended vertically uprightly from a supporting member.

* * * * *

UNITED STATES PATENT AND TRADEMARK OFFICE

CERTIFICATE OF CORRECTION

PATENT NO. : 4,209,157

DATED : Jun. 24, 1980

INVENTOR(S) : John H. Edmisten

It is certified that error appears in the above-identified patent and that said Letters Patent are hereby corrected as shown below:

Column 1, line 20, delete the word "hunder" and insert therefor - hunter -.

Column 4, line 1, delete "fom" and insert therefor - form -.

Column 6, line 18, after the word "member" delete one of the commas (,).

Signed and Sealed this

*Eleventh* Day of *November 1980*

[SEAL]

*Attest:*

SIDNEY A. DIAMOND

*Attesting Officer*

*Commissioner of Patents and Trademarks*